US005598692A

United States Patent [19]

Tsuzuki

[11] Patent Number: 5,598,692

[45] **Date of Patent: *Feb. 4, 1997**

[54] APPARATUS AND METHOD FOR DELIVERY OF SLIVER TO RING SPINNING MACHINES

[75] Inventor: Kiyohiro Tsuzuki, Greenville, S.C.

[73] Assignee: TNS Mills Inc., Greenville, S.C.

[ * ] Notice: The term of this patent shall not extend beyond the expiration date of Pat. No. 5,333,440.

[21] Appl. No.: 480,502

[22] Filed: Jun. 7, 1995

Related U.S. Application Data

[63] Continuation of Ser. No. 242,411, May 13, 1994, abandoned, which is a continuation-in-part of Ser. No. 134,461, Oct. 8, 1993, Pat. No. 5,333,440, which is a continuation of Ser. No. 934,877, Aug. 21, 1992, abandoned.

[51] Int. Cl.[6] ..... D01H 13/02; D01H 5/28

[52] U.S. Cl. ..... 57/90; 57/308; 57/315; 57/408

[58] Field of Search ..... 57/90, 315, 308, 57/408

[56] References Cited

U.S. PATENT DOCUMENTS

| | | | |
|---|---|---|---|
| 3,070,948 | 1/1963 | Tsuzuki | 57/308 |
| 3,469,385 | 9/1969 | Tsuzuki | 57/308 |
| 3,564,829 | 2/1971 | Tsuzuki | 68/5 D X |
| 3,650,104 | 3/1972 | Shepherd et al. . | |
| 3,787,615 | 1/1974 | Foerster et al. . | |
| 3,816,991 | 6/1974 | Takeuchi et al. | 57/90 |
| 4,022,007 | 5/1977 | Motobayashi et al. | 57/308 X |
| 4,098,065 | 7/1978 | Stahlecker et al. . | |
| 4,150,530 | 4/1979 | Derichs . | |
| 4,497,168 | 2/1985 | Kamp . | |
| 4,590,757 | 5/1986 | Stahlecker . | |
| 4,607,485 | 8/1986 | Stahlecker . | |
| 4,922,707 | 5/1990 | Meroni et al. . | |
| 4,932,201 | 6/1990 | Meroni et al. . | |
| 4,939,895 | 7/1990 | Raasch et al. . | |
| 5,153,606 | 10/1992 | Bas | 346/76 PH |
| 5,333,440 | 8/1994 | Tsuzuki | 57/90 |

*Primary Examiner*—William Stryjewski
*Attorney, Agent, or Firm*—Hardaway Law FIrm PA

[57] ABSTRACT

A plant structure having three floors with first and second ring spinning apparatuses located on the first floor and with vertical sliver feed tubes extending from the first and second ring spinning apparatuses respectively to the second floor for feeding a sliver through the sliver feed tube to the first ring spinning apparatus and to the third floor for feeding sliver from a can thereof to said second ring spinning apparatus. Each of the sliver feed tubes is provided with a fitting, including a slide section extending at an obtuse angle to the tubes, such that sliver strands descend through the tubes and through the associated fittings before they are fed into associated ring spinning machines.

3 Claims, 3 Drawing Sheets

APPARATUS AND METHOD FOR DELIVERY OF SLIVER TO RING SPINNING MACHINES

RELATED APPLICATION DATA

This application is a file wrapper continuation of application Ser. No. 08/242/411, filed May 13, 1994 now abandoned, which is a continuation-in-part of application Ser. No. 08/134,461, filed Oct. 8, 1993, now U.S. Pat. No. 5,333,440 which is a continuation of application Ser. No. 07/934,877, filed Aug. 21, 1992, now abandoned.

BACKGROUND OF THE INVENTION

This invention relates generally to the art of textiles and more particularly to a plant structure for the spinning of textile fibers into yarn products.

Various plant structures have existed for the production of textile yarns for ultimately weaving or knitting into desired fabric.

Traditionally, two techniques of spinning have been utilized, i.e. ring spinning and open-end spinning. An example of open-end spinning is described in U.S. Pat. No. 4,939,895 to Raasch, et al. assigned to W. Schlafhorst & Co. of Germany. As described in this particular patent, cans of coiled sliver typically are positioned on the floor adjacent to an open-end spinning apparatus and vertically bent upwardly into the open-end spinning apparatus.

An example of an open-end spinning apparatus is the Autocoro 240 automatic rotor spinning and winding machine produced and sold by W. Schlafhorst & Co.

In a conventional plant arrangement, a roving frame carrying a plurality of sliver spools is positioned proximate associated ring spinning machines. While plants have effectively operated utilizing this arrangement, the formation of spools and the manual changing of spent spools on the roving frame have been known to consume significant amounts of time. Moreover, roving frames require considerable floor space. Thus, room exists for improvement in the overall plant operations utilizing ring spinning devices.

SUMMARY OF THE INVENTION

It is thus an object of this invention to provide a novel plant arrangement of a ring spinning apparatus which provides improvements over a conventional plant arrangement.

It is a further and more particular object of this invention to provide such a novel ring spinning apparatus arrangement wherein the number of such ring spinning apparatuses may be maximized per square foot of the floor maintaining such apparatus.

It is a further and more particular object of this invention to provide a novel apparatus for feeding a sliver to a ring spinning apparatus.

It is a further and yet more particular object of this invention to provide a novel plant structure for housing such ring spinning apparatus.

These as well as other objects are accomplished by a plant structure comprising a building structure having first, second and third floors therein, first and second ring spinning apparatuses located adjacent one another on the first floor, a first sliver feed tube on the second floor for directing sliver from a can located on the second floor to the first ring spinning apparatus, and a second sliver feed tube extending from the third floor to the second ring spinning apparatus for directing sliver from a can located on the third floor to the second ring spinning apparatus. Each of the sliver feed tubes has a vertical portion and is provided with a fitting making an obtuse angle with the vertical portion proximate a lower end of the vertical portion such that the sliver travels downwardly through the vertical portion and then through the fitting.

DETAILED DESCRIPTION

In accordance with this invention it has been found that a plant housing apparatus for the ring spinning of textile fibers into yarns may be operated with considerably greater efficiency both from the space standpoint and from the man hours standpoint by locating the ring spinning apparatuses on the first floor of an at least three story plant structure and by feeding sliver to the spinning apparatuses alternately from the second and third floors of the plant facility. Sliver feed tubes are provided to appropriately direct the sliver from the second and third stories to adjacent ring spinning apparatuses. Various other advantages and features will become apparent from the following description given with reference to the various figures of drawings.

Figure 1:
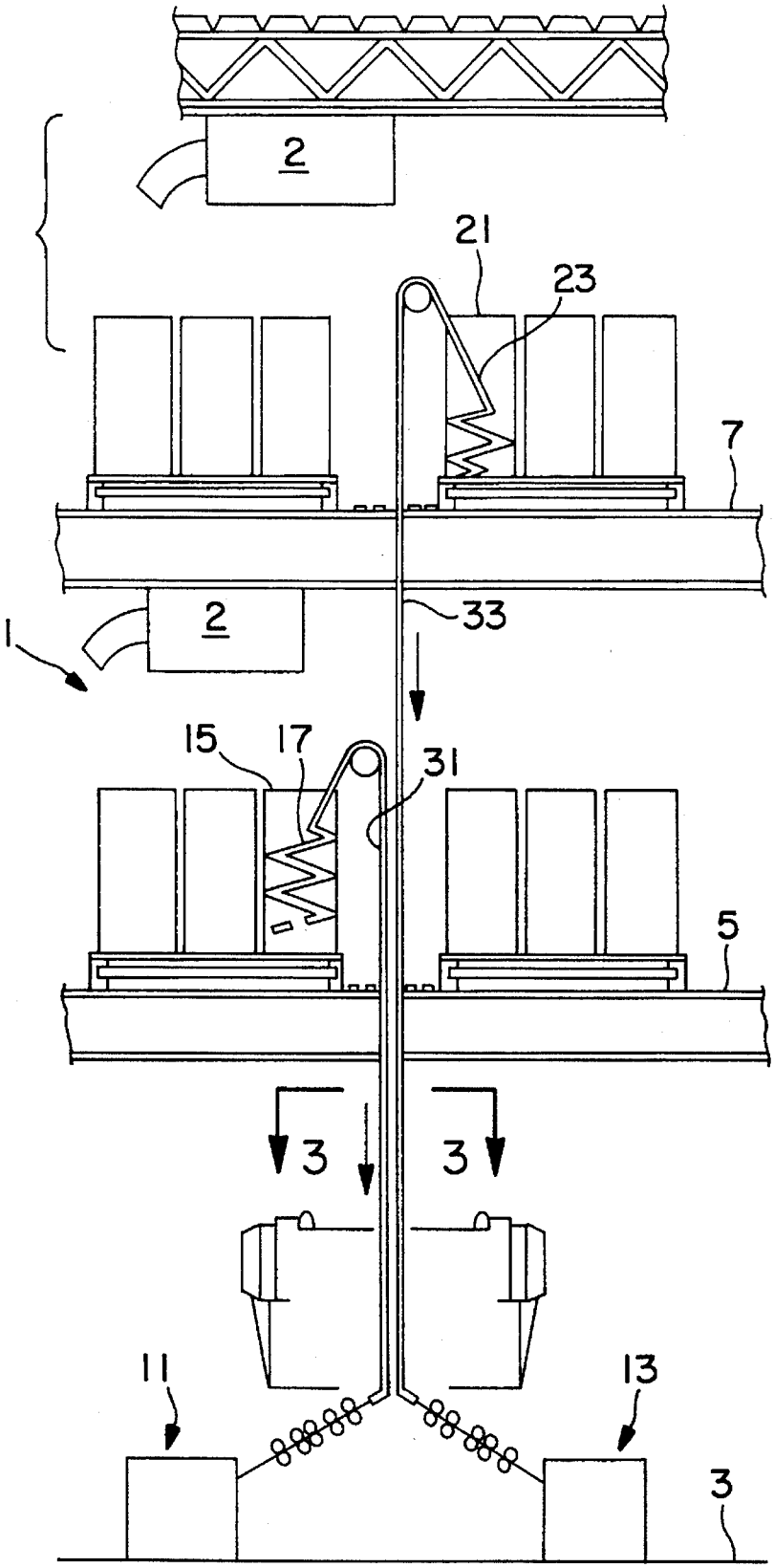
FIG. 1 of the drawings illustrates a plant structure in accordance with this invention.

FIG. 1 of the drawings illustrates generally a plant structure 1 having a first floor 3, a second floor 5 and a third floor 7. Located on the first floor or ground floor 3 are conventional first and second ring spinning apparatuses 11 and 13.

Located on the second floor 5 are a plurality of cans referenced as 15 containing sliver 17 spiralled therein. Sliver 17 is formed by techniques known in the textile art for the cleaning and opening of textile fibers such as cotton.

The third floor 7 contains an arrangement similar to the second floor 5 having cans such as 21, also having sliver 23 coiled therein.

The arrangement in accordance with this invention of utilizing sliver cans on the second and third floors permit the second and third floors to have very tightly controlled temperature and humidity conditions so as to have a sliver properly conditioned for the ring spinning process. This is achieved by the use of conventional air conditioners 2 located on the second or third floors. There are significant efficiency and energy savings associated with the maintenance of the sliver containers in the second and third floor configuration of this invention. The first floor 3, housing the ring spinning apparatuses 11, 13, is maintained at a different temperature and humidity which is more appropriate for spinning. It has been found to be highly advantageous to separately maintain the sliver at an optimum conditioning temperature while spinning at a different but optimum spinning temperature and humidity.

The conventional can is normally at a maximum of twenty inches by forty-eight inches, which does not allow a significant amount of sliver in each can and requires significant and frequent replacement. According to this invention, however, fourteen inch by fifty inch (14"×50") cans 15 can be utilized, thus accommodating more sliver and requiring considerably less frequent changing of the cans 15.

Sliver feed tubes 31 and 33 extend respectively from the second floor 5 and the third floor 7 to appropriately direct the sliver toward ring spinning apparatuses 11 and 13. As shown in FIG. 1, it is seen that the sliver feed tubes 31, 33 pass through the floor structures of the second and third floors 5 and 7. The sliver feed tubes 31, 33 may be immediately adjacent a sliver can or may terminate just above the appropriate floor structure.

Figure 2:
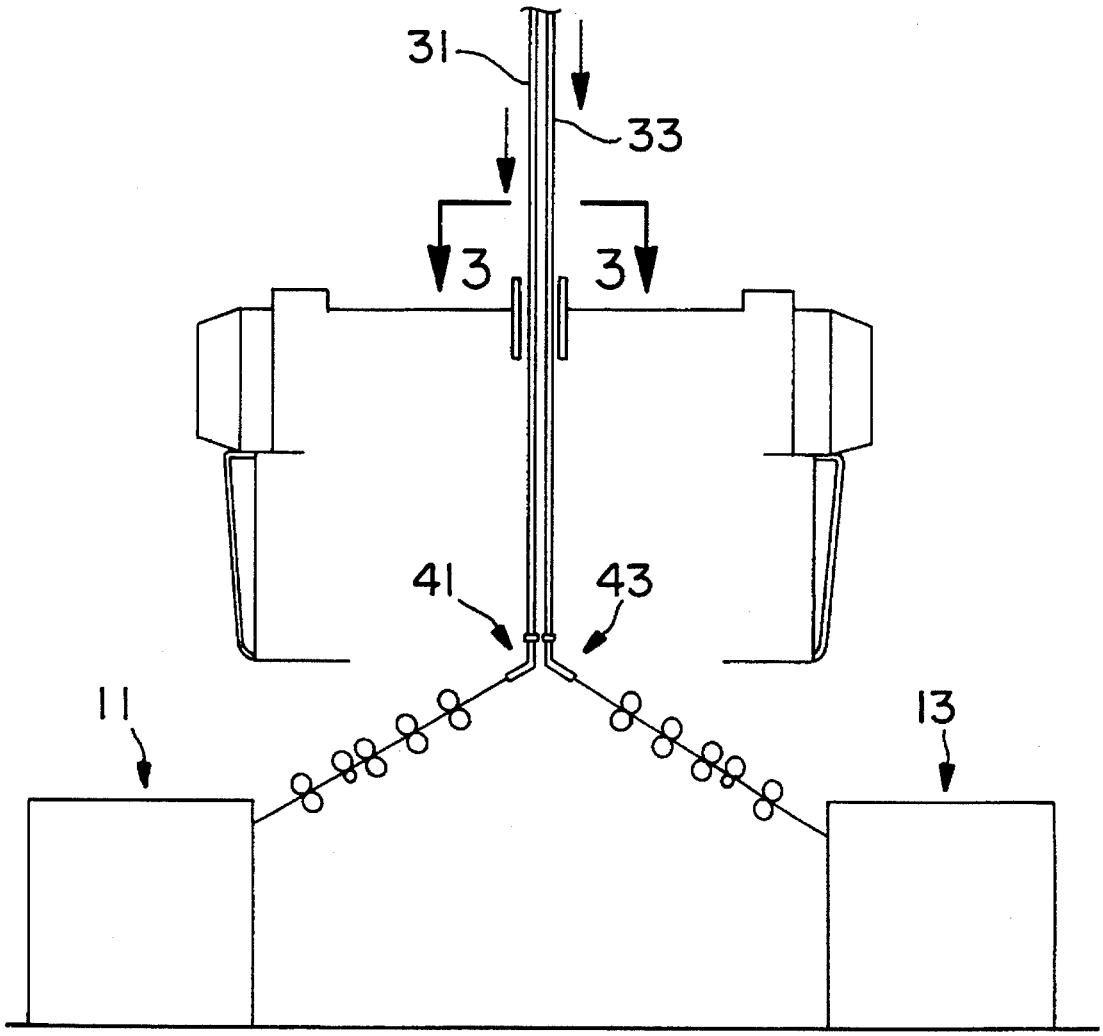
FIG. 2 of the drawings schematically illustrates the feeding of a ring spinning apparatus in accordance with this invention.

Referring to FIG. 2 of the drawings, which is shown in greater detail with regard to the first floor structure, it is seen that the sliver feed tubes 31, 33 each extend vertically downwardly and are provided with fittings 41 and 43, respectively. Thus, sliver travels through a sliver feed tube and then through a fitting, at which point the sliver is fed directly to the intake of the ring spinning apparatus. Utilizing this construction, no modification of the ring spinning apparatus is required, and it generally still receives the sliver in the same manner that it would receive a sliver if it were fed directly from a spool on a closely proximate roving frame.

The sliver feed tube utilized in accordance with this invention is generally a smooth, hollow construction and preferably is made transparent so that the movement of the sliver through the tube may be visually observed. It is critical to this invention to have the sliver descend through the tubes without any breakage. The tube must be of sufficient diameter to permit the sliver to pass down in a snake-like fashion without significant rubbing on the walls of the tube. The tube walls also include an anti-static agent to prevent sticking should contact occur.

Figure 3:
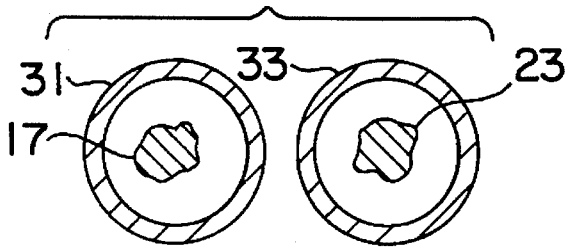
FIG. 3 of the drawings is a cross-sectional view along the line 3—3 of FIG. 1.

Referring to FIG. 3 of the drawings, sliver feed tubes 31 and 33 respectively have sliver 17 and 23 passing therethrough. The interior surface of the sliver feed tubes 31 and 33 should be very smooth so as to not snag sliver passing therethrough. A material possessing the requisite characteristics of smoothness is generally an extruded tubing formed from polyvinyl chloride (PVC), which is the type of material normally utilized for beverage containers.

Figure 4:
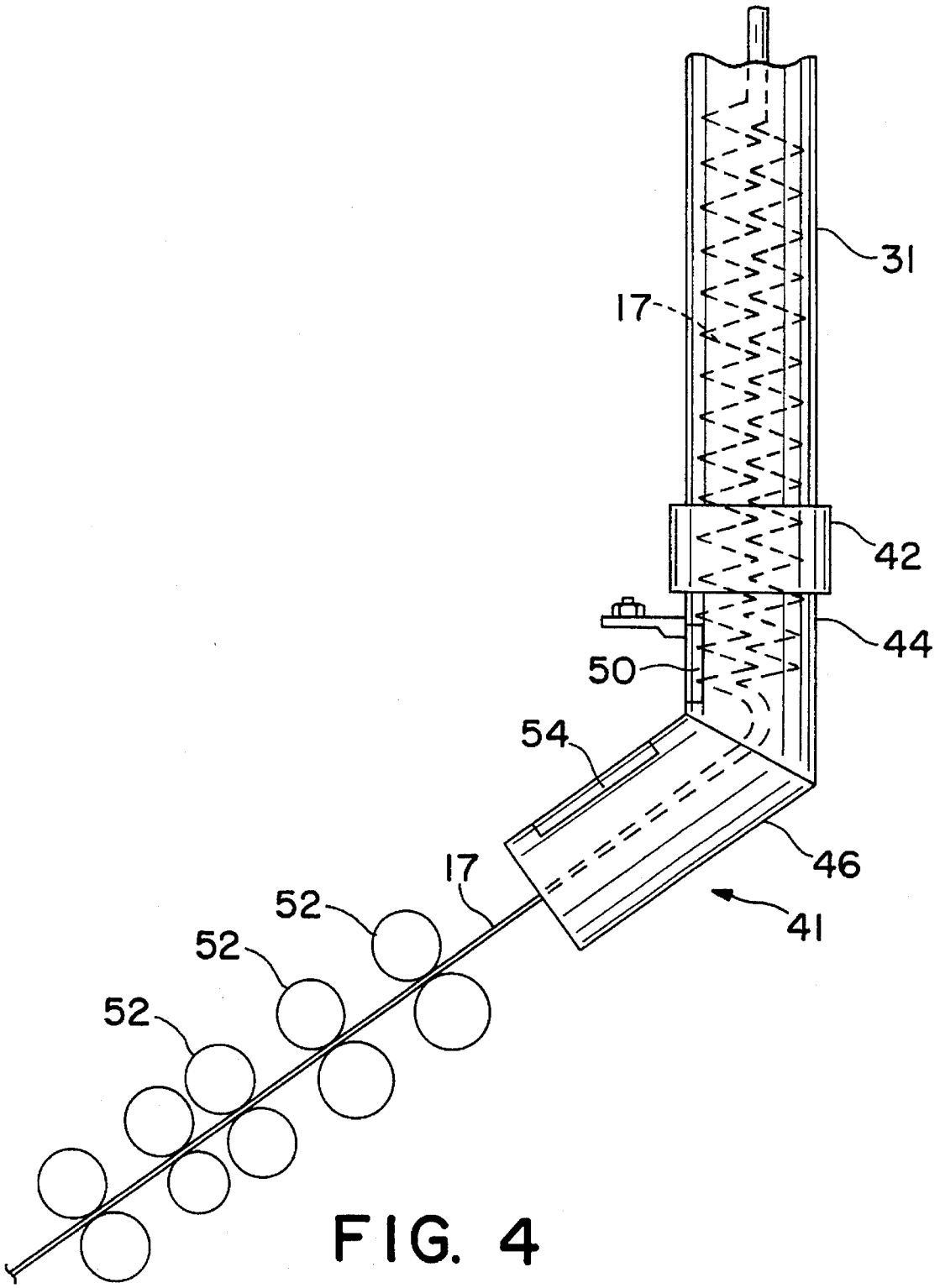
FIG. 4 of the drawings is a side elevation view illustrating a sliver feed tube fitting constructed in accordance with this invention.

FIG. 4 illustrates a typical sliver tube fitting, for example, fitting 41, in detail. Fitting 41 includes an inlet section 42 which is press fit over the lower end of a sliver feed tube 31 and which extends vertically therefrom, a brake section 44 extending vertically from the inlet section 42, and a slide section 46 extending at an obtuse angle to the brake section 44, and thus to the sliver feed tube 31. A brake 50 is mounted onto the exterior surface of brake section 44 to temporarily halt the descent of a portion of sliver 17 until nip rollers 52 of ring spinning apparatus 13 (FIG. 2) exert a pull on that portion. A cover 54 is hingedly mounted on the exterior surface of slide section 46 to permit periodic inspection of a taut portion of sliver 17 just before it passes to the nip rollers 52. The fitting 41 is preferably constructed of PVC and should possess identical characteristics discussed above with regard to the sliver feed tubes 31, 33, except that fitting 41 is preferably opaque.

In an alternate embodiment of the present invention, a fitting may be eliminated entirely, provided that a lower portion of a sliver feed tube is bent at an obtuse angle with respect to a vertically-extending portion of the sliver feed tube.

It is thus seen that this invention provides a novel plant structure for the ring spinning of textile fibers into yarns. It is seen that such plant structure maximizes efficiency with regard to space utilization and worker accessibility to machinery. As many variations will become apparent to those of skill in the art, such variations are embodied within the spirit and scope of this invention as measured by the following appended claims.

That which is claimed:

1. A discrete fitting adapted for engagement with a lower end of a sliver feed tube, sliver being fed through said sliver feed tube from a point adjacent a plant ceiling to a point adjacent a ring spinning device on said plant floor, said fitting comprising:

an inlet directly communicating with said lower end of said sliver tube;

a brake section directly extending vertically downwardly from said inlet, said brake section including a vertically oriented stationary brake to temporarily slow descent of a portion of sliver through said sliver feed tube without blocking said sliver feed tube; and a slide section extending at an obtuse angle to said brake section, being longer than said brake section and ending immediately adjacent a spinning device.

2. The discrete fitting according to claim 1 wherein said discrete fitting is constructed of PVC.

3. A discrete fitting adapted for engagement with a lower end of a sliver feed tube, said sliver tube having a length greater than the distance between a plant ceiling and a ring spinning device on said plant floor, said fitting having a length substantially less than the length of the sliver tube and comprising:

an inlet directly communicating with said lower end of said sliver tube;

a brake section directly extending vertically downwardly from said inlet, said brake section including a vertically oriented stationary brake to temporarily slow descent of a portion of sliver through said sliver feed tube without blocking said sliver feed tube; and a slide section extending at an obtuse angle to said brake section, being longer than said brake section and ending immediately adjacent a spinning device; and further comprising a cover mounted on an exterior surface of said slide section to permit periodic inspection of a taut portion of said sliver just before it is fed into a ring spinning apparatus.

* * * * *